US006808024B2

(12) United States Patent
Schwendemann et al.

(10) Patent No.: US 6,808,024 B2
(45) Date of Patent: Oct. 26, 2004

(54) DOWNHOLE SEAL ASSEMBLY AND METHOD FOR USE OF SAME

(75) Inventors: Kenneth L. Schwendemann, Flower Mound, TX (US); Darrin N. Towers, Carrollton, TX (US); Brian D. Higgins, Flower Mound, TX (US); Beegamudre N. Murali, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/151,276

(22) Filed: May 20, 2002

(65) Prior Publication Data

US 2003/0213601 A1 Nov. 20, 2003

(51) Int. Cl.[7] ..... E21B 33/12
(52) U.S. Cl. ..... 166/387; 166/180; 166/242.2
(58) Field of Search ..... 166/387, 384, 166/385, 120, 242.7, 180, 118

(56) References Cited

U.S. PATENT DOCUMENTS 4,614,346 A * 9/1986 Ito ..... 277/334
4,791,992 A * 12/1988 Greenlee et al. ..... 166/387
4,886,117 A * 12/1989 Patel ..... 277/334
5,404,956 A * 4/1995 Bohlen et al. ..... 166/387
5,701,959 A * 12/1997 Hushbeck et al. ..... 166/387
5,913,337 A 6/1999 Williams et al. ..... 138/125
5,921,285 A * 7/1999 Quigley et al. ..... 138/125
5,941,313 A * 8/1999 Arizmendi ..... 166/387
6,004,639 A * 12/1999 Quigley et al. ..... 428/36.3
6,173,788 B1 * 1/2001 Lembcke et al. ..... 166/387
2002/0070034 A1 * 6/2002 Whitsitt ..... 166/387
2002/0121380 A1 * 9/2002 Doane et al. ..... 166/382

* cited by examiner

*Primary Examiner*—David Bagnell
*Assistant Examiner*—Daniel P Stephenson
(74) *Attorney, Agent, or Firm*—Lawrence R. Youst

(57) ABSTRACT

A seal assembly (60) for controlling the flow of fluids in an annulus (68) between a continuous tubular (62) and a cased wellbore (64) is disclosed. The seal assembly (60) includes anchor slips (72) and a seal element (78). The seal assembly (60) is actuated by communicating hydraulic fluid to a setting assembly (82) via an operating fluid conduit integral with the tubular (62). Upon actuation, the setting assembly (82) axially shifts a pair of slip ramps (74, 76) which radially expands the anchor slips (72) into gripping engagement with the wellbore (64) and radially expands the seal element (78) into sealing engagement with the wellbore (64).

37 Claims, 6 Drawing Sheets

DOWNHOLE SEAL ASSEMBLY AND METHOD FOR USE OF SAME

TECHNICAL FIELD OF THE INVENTION

This invention relates, in general, to sealing devices and, in particular, to a system and method for creating a fluid seal between production tubing and well casing by energizing a seal element positioned around a section of the production tubing.

BACKGROUND OF THE INVENTION

Without limiting the scope of the present invention, its background will be described with reference to producing fluid from a subterranean formation, as an example.

After drilling each of the sections of a subterranean wellbore, individual lengths of relatively large diameter metal tubulars are typically secured together to form a casing string that is positioned within each section of the wellbore. This casing string is used to increase the integrity of the wellbore by preventing the wall of the hole from caving in. In addition, the casing string prevents movement of fluids from one formation to another formation.

Conventionally, each section of the casing string is cemented within the wellbore before the next section of the wellbore is drilled. Accordingly, each subsequent section of the wellbore must have a diameter that is less than the previous section. For example, a first section of the wellbore may receive a conductor casing string having a 20-inch diameter. The next several sections of the wellbore may receive intermediate casing strings having 16-inch, 13⅜-inch and 9⅝-inch diameters, respectively. The final sections of the wellbore may receive production casing strings having 7-inch and 4½-inch diameters, respectively. Each of the casing strings may be hung from a casinghead near the surface. Alternatively, some of the casing strings may be in the form of liner strings that extend from near the setting depth of previous section of casing. In this case, the liner string will be suspended from the previous section of casing on a liner hanger.

Once this well construction process is finished, the completion process may begin. For example, the completion process may include creating hydraulic openings or perforations through the production casing string, the cement and a short distance into the desired formation or formations so that production fluids may enter the interior of the wellbore. In addition, the completion process may involve formation stimulation to enhance production, gravel packing to prevent sand production and the like. The completion process also includes installing a production tubing string within the well that extends from the surface to the production interval or intervals.

Unlike the casing strings that form a part of the wellbore itself, the production tubing string is used to produce the well by providing the conduit for formation fluids to travel from the formation depth to the surface. In addition, tools within the tubing string provide for the control of the fluids being produced from the formation. For example, the production tubing string typically includes one or more seal assemblies. The seal assemblies may be installed above and below a production interval to isolate the production from that interval or a single seal assembly may be installed at a depth slightly above the casing perforations in a well having a single completion or at the deepest completion. In this case, the end of the production tubing string may be left open to allow production fluid to enter the production tubing.

Once the seal assembly is properly positioned, the seal assembly is actuated to create a sealing and gripping relationship with the walls of the adjacent casing or liner. Accordingly, in the single seal assembly case discussed above, the seal assembly seals the annular space between the production tubing and the casing above the perforations such that the produced fluids that flow through the perforations must enter the open end of the tubing string.

To achieve the gripping relationship, typical seal assemblies are equipped with anchor slips that have opposed camming surfaces that cooperate with complementary opposed wedging surfaces. The anchor slips are radially extendable into gripping engagement against the well casing bore in response to relative axial movement of the wedging surfaces. To achieve the sealing relationship, typical seal assemblies carry annular seal elements that are expandable radially into sealing engagement against the bore of the well casing in response to an axial compression force. Mechanical or hydraulic means typically may be used to set the anchor slips and the sealing elements. For example, the mechanically set seal assemblies may be actuated by pipe string rotation or reciprocation. Alternatively, mechanically set seal assemblies may be actuated by employing a setting tool that is run downhole and coupled to the seal assembly for setting. Likewise, hydraulically set seal assemblies may be actuated using a setting tool that is run downhole and coupled in fluid communication with the seal assembly. Alternatively, elevating the fluid pressure within the tubing string may be used to actuate hydraulically set seal assemblies.

It has been found, however, that each of these conventional setting operations is suitable only when the seal assembly is positioned within a string of jointed tubing wherein relative rotation between the pipe string and the seal assembly is possible or wherein mechanical or hydraulic access if available to the seal assembly from the interior of the pipe string. Accordingly, such conventional seal assemblies using conventional setting techniques are not suitable for use with continuous tubing such as coiled tubing or composite coiled tubing.

Therefore a need has arisen for a seal assembly that is capable of creating a sealing and gripping relationship between a continuous tubing and a well casing. A need has also arisen for a method for assembling such a seal assembly for use on continuous tubing. In addition, a need has arisen for a method of actuating such a seal assembly to create the sealing and gripping relationship between a continuous tubing and a well casing.

SUMMARY OF THE INVENTION

The present invention disclosed herein comprises a downhole seal assembly that is capable of creating a sealing and gripping relationship between a continuous tubing and a well casing. The seal assembly of the present invention may be assembled to the exterior of the continuous tubing. In addition, the seal assembly of the present invention may be actuated downhole to create the sealing and gripping relationship between a continuous tubing and a well casing.

In one aspect, the present invention is directed to a seal assembly for controlling the flow of fluids in a wellbore. The seal assembly may be positioned on a section of continuous tubular such as a section of composite coiled tubing which may include a plurality of composite layers, a substantially impermeable material lining an inner surface of the innermost composite layer forming a fluid passageway and an operating fluid conduit integrally positioned between two of the composite layers. The seal assembly includes a mandrel having a flange that is positioned around the section of the tubular. First and second slip ramps are positioned around the mandrel. Anchor slips are positioned around the mandrel between the first and second slip ramps such that the anchor slips may be radially extended into a gripping engagement against the wellbore in response to relative axial movement of the first and second slip ramps toward one another.

The seal assembly also includes a setting assembly that is positioned around the mandrel and in fluid communication with the operating fluid conduit. The setting assembly is hydraulically actuated to axially shift the first slip ramp toward the second slip ramp. The seal assembly also has a seal element positioned around the mandrel between the flange and the second slip ramp. The seal element is actuatable into a sealing engagement with the wellbore in response to a compressive axial force applied to the seal element between the second slip ramp and the flange after actuation of the setting assembly.

In one embodiment, the seal element may comprise a sheet that is wrapped around the mandrel to form a plurality of layers. In another embodiment, the seal element may comprise a plurality of arc shaped segments that are positioned around the mandrel to form an annular member. In yet another embodiment, the seal element may comprise first and second sections having a jointed slidably engagable relationship. The first and second sections may each have a plurality of seal members that form a sealing engagement with the wellbore in response to the first and second sections being axially shifted toward one another. In another embodiment, the seal element may comprise a spoolable member that is wound around the mandrel to form a plurality of turns.

In the wrapped, segmented and spoolable embodiments of the seal element, the seal element may comprise elastomers, rubbers, or other material suitable for sealing. The seal element may be subjected to a crosslinking reaction to increase the strength and resiliency of the extrudable material and to unitize the seal element. The crosslinking reaction may be vulcanization, a radiation crosslinking reaction, a photochemical crosslinking reaction, a chemical crosslinking reaction or other suitable reaction.

In another aspect, the present invention is directed to a method for assembling a seal assembly on a tubular having an operating fluid conduit associated therewith. The method comprises positioning a mandrel having a flange around the exterior of the tubular, disposing first and second slip ramps around the mandrel, positioning anchor slips around the mandrel between the first and second slip ramps, coupling a setting assembly around the mandrel, establishing fluid communication between the operating fluid conduit and the setting assembly and positioning a seal element around the mandrel between the flange and the second slip ramp.

In another aspect, the present invention is directed to a method for operating a seal assembly. The method comprises disposing the tubular within a wellbore, communicating an operating fluid to the setting assembly through the operating fluid conduit, axially shifting the first slip ramp toward the second slip ramp with the setting assembly, radially expanding the anchor slips into gripping engagement with the wellbore in response to the relative axially movement of the first and second slip ramps and radially expanding the seal element into sealing engagement with the wellbore in response to a compressive axial force applied to the seal element between the second slip ramp and the flange.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
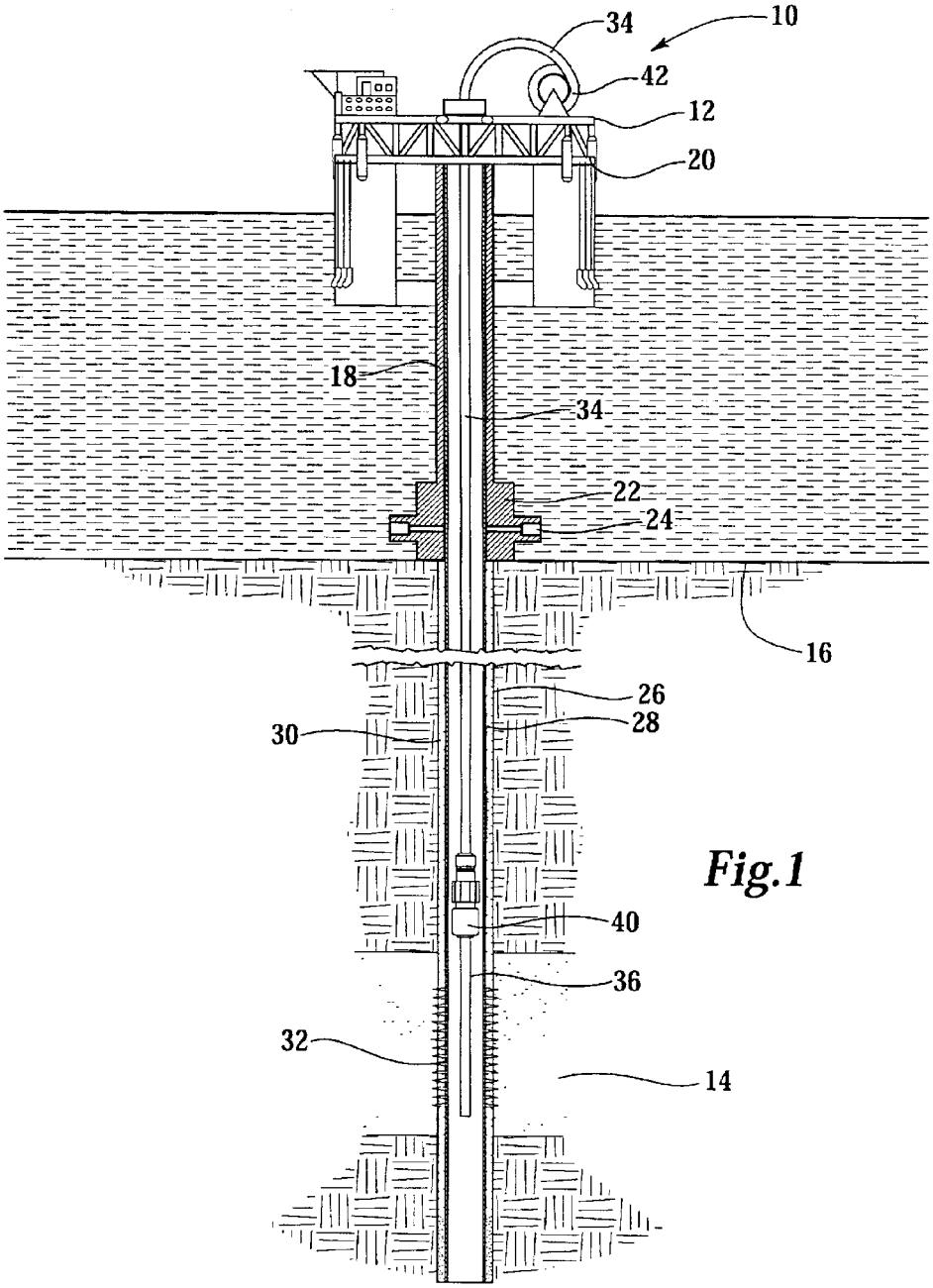
FIG. 1 is a schematic illustration of an offshore oil and gas platform installing a downhole seal assembly according to the present invention.

Referring initially to FIG. 1, an offshore oil and gas platform installing completion equipment that includes a seal assembly for controlling the flow of fluids is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blowout preventers 24. A wellbore 26 is lined with a casing string 28. Casing string 28 is cemented within wellbore 26 by cement 30. Perforations 32 provide a fluid communication path from formation 14 to the interior of wellbore 26. A continuous tubular 34 runs from the surface to a position proximate to formation 14. An annulus 36 is formed between continuous tubular 34 and wellbore 26. A seal assembly 40 of the present invention is coupled near the lower end of a section of continuous tubular 34. Reel 42 feeds continuous tubular 34 into wellbore 26 to a position proximate formation 14. Once positioned and actuated, seal assembly 40 of the present invention controls the flow of fluids in annulus 36 between continuous tubular 34 and wellbore 26 forcing the flow of fluids down annulus 36 and into the open end of continuous tubular 34.

Figure 2:
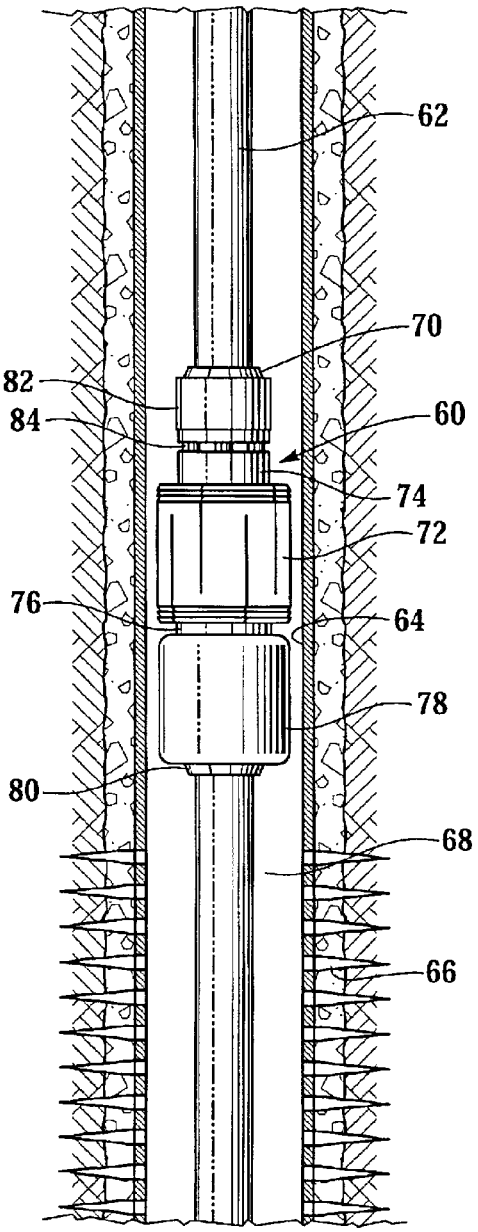
FIG. 2 is a half sectional view of a seal assembly according to the present invention positioned within a wellbore prior to actuation.

Referring now to FIG. 2, a seal assembly 60 of the present invention is positioned around a section of continuous production tubing 62 that extends into cased wellbore 64 having perforations 66. Seal assembly 60 is used to support continuous production tubing 62 and the other completion equipment and to provide a fluid seal between continuous production tubing 62 and wellbore 64 to prevent fluid flow up an annulus 68 beyond the location of seal assembly 60. Seal assembly 60 is equipped with mandrel 70 positioned against and around continuous production tubing 62. Seal assembly 60 also includes anchor slips 72 that have opposed camming surfaces that cooperate with complementary opposed slip ramps 74, 76. Anchor slips 72 are radially extendable into gripping engagement against cased wellbore 64, in response to relative axial movement of slip ramps 74, 76.

Seal assembly 60 also carries a seal element 78 that is radially expandable into sealing engagement against cased wellbore 64, in response to an axial compression force applied to seal element 78 between slip ramp 76 and a flange 80 of mandrel 70. Seal assembly 60 includes setting assembly 82 that is used to actuate anchor slips 72 and seal element 78. Hydraulic, electro-hydraulic or mechanical means may be employed to set anchor slips 72 and seal element 78. As explained in more detail below, one or more operating fluid conduits and one or more electrical conduits run from the surface to seal assembly 60 and are used to actuate anchor slips 72 and seal element 78. In the illustrated embodiments, the operating fluid conduits and electrical conduits are integral with continuous production tubing 62.

Alternatively, the operating fluid conduits and electrical conduits may be run on the outside of a tubing string. It should be understood by one skilled in the art that although a single seal assembly is illustrated as being positioned above a production interval, other seal assembly configurations are possible. For example, seal assemblies may be installed above and below a production interval to isolate the production from an interval. Likewise, numerous seal assemblies of the present invention may be required when multiple production intervals are traversed by the wellbore.

Figure 3:
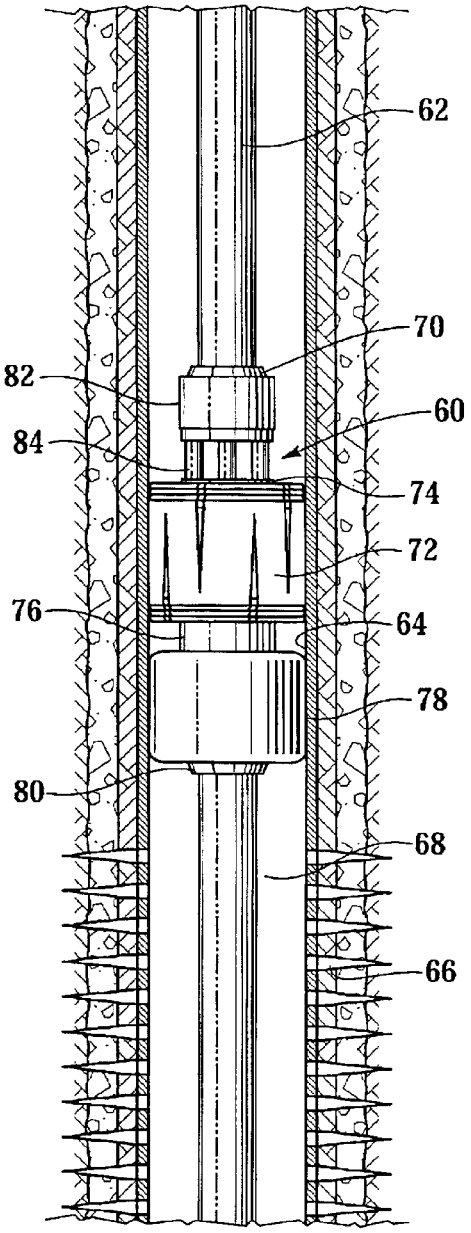
FIG. 3 is a half sectional view of the seal assembly according to the present invention positioned within a wellbore after actuation.

FIG. 3 depicts seal assembly 60 after actuation. Specifically, hydraulic fluid is allowed to enter setting assembly 82 from the operating fluid conduits by opening a valve, for example, an electrically operated solenoid valve, and allowing the hydraulic pressure to operate on pistons 84 of setting assembly 82. Pistons 84 axially shift slip ramp 74 toward slip ramp 76. In response to the axial movement of slip ramps 74 anchor slips 72 radially extend into gripping engagement against cased wellbore 64, and, likewise, the simultaneous downward axial movement of slip ramp 76 compresses seal element 78 against flange 80 such that seal element 78 expands radially into a sealing engagement with cased wellbore 64. In this position, the flow of fluids in annulus 68 between continuous production tubing 62 and cased wellbore 64 is prevented. Accordingly, produced fluids may only flow down annulus 68 to the open end of continuous production tubing 62 and into the fluid passageway within continuous production tubing 62 to the surface.

After seal assembly 60 has been set and sealed against cased wellbore 64, it is designed to maintain the seal after the hydraulic setting force is removed. Seal assembly 60 then remains locked in its set and sealed configuration when subjected to extreme downhole temperatures and high downhole pressures.

Figure 4:
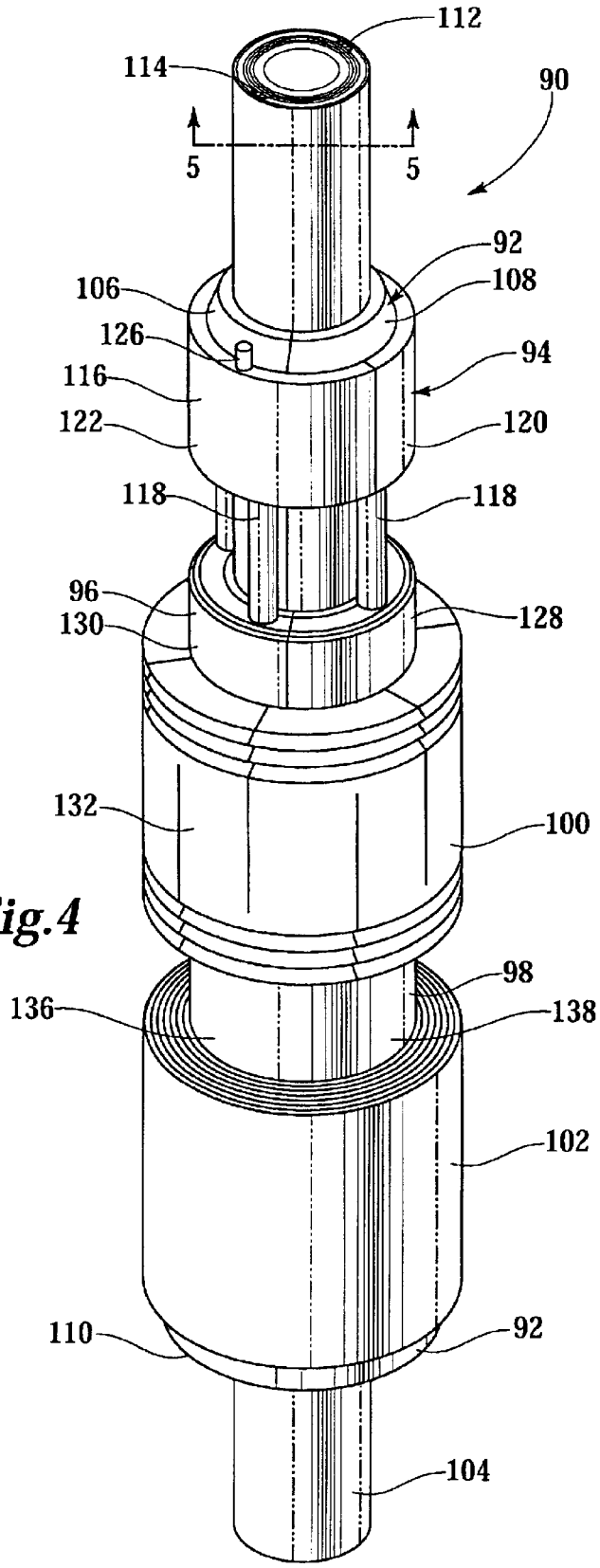
FIG. 4 is a perspective view illustrating the construction of a seal assembly of the present invention.

Referring now to FIG. 4, therein is depicted a seal assembly 90 of the present invention. Seal assembly 90 includes a mandrel 92, a setting assembly 94, slip ramps 96, 98, anchor slips 100 and seal element 102 disposed about a section of composite coiled tubing 104. More specifically, mandrel 92 is positioned around composite coiled tubing 104. Mandrel 92 may comprise two sections 106, 108 each forming a 180 degree section of mandrel 92. Mandrel 92 is coupled to composite coiled tubing 104 using adhesive or other suitable technique. Preferably, the inside surface of mandrel 92 has a rough or uneven profile or other mechanical arrangement to help prevent axial movement of mandrel 92 relative to composite coiled tubing 104. The two sections 106, 108 of mandrel 92 are coupled to one another by bolting or other suitable technique. Mandrel 92 includes a flange 110 at the far end.

Prior to or after the installation of mandrel 92 on composite coiled tubing 104, one or more penetrations are made through mandrel 92 and composite coiled tubing 104 to establish fluid communication to operating fluid conduit 112 and electrical conduit 114, the operation of which is discussed in greater detail below.

Setting assembly 94 includes a piston housing 116 and multiple pistons 118 positioned around the near end of mandrel 92. In the illustration embodiment, piston housing 116 has a split design comprising two sections 120, 122 each forming 180 degrees of piston housing. Sections 120, 122 that are preferably bolted or welded together. Piston housing 116 is supported against mandrel 92 by friction, bolting, welding adhesion or other suitable technique. It should be understood by those skilled in the art that piston housing 116 may alternatively comprise more than two sections. Each piston 118 is a cylindrical sliding piece that is operated in response to fluid pressure within a portion of piston housing 94 that is selectively in communication with operating fluid conduit 112 via the penetration through mandrel 92 and composite coiled tubing 104. Although a specific number of pistons is illustrated, it should be understood by one skilled in the art that any number of pistons are possible.

A solenoid valve 126 allows hydraulic pressure to act on pistons 118 so that, in turn, pistons 118 act on slip ramp 96. The electric signal required to actuate solenoid valve 126 is provided by electrical conduit 114 that is integral to composite coiled tubing 104 as discussed in more detail below. The hydraulic pressure is provided by an operating fluid conduit 112 that is integral to composite coiled tubing 104 as discussed in more detail below. Preferably, hydraulic control conduit 112 provides fluid communication between a surface hydraulic source or reservoir and piston housing 116. The previously mentioned penetration made through mandrel 92 and composite coiled tubing 104 allows a tap or line to connect electric conduit 114 and hydraulic control conduit 112, respectively, to piston housing 116. It should be understood by those skilled in the art that other control arrangements are possible and within the teachings of the present invention. For example, a hydraulically controlled valve may replace the electrically controlled solenoid valve 126. Alternatively, an electrically controlled solenoid valve may be actuated using electricity stored in downhole batteries that are charged via induction from current travel in a loop created by electric conduit 114.

Slip ramp 96 is positioned around mandrel 92. Slip ramp may comprise two wedge-shaped sections 128, 130 each forming 180 degrees of slip ramp 96. Sections 128, 130 are welded, bolted or connected together by other suitable technique. Slip ramp 96 is operable to axially slid about mandrel 92 and upon actuation of the seal assembly 90, slip ramp 96 axially slides within the interior of anchor slips 100 to radially expand anchor slips 100.

Anchor slips 100 comprise multiple individual slip elements 132 coupled together to form a C-shaped member that may be spread open to fit around mandrel 92 then assembled into the illustrated annular shape. The ends may then be welded together or otherwise attached. Slip elements 132 slip have a gripping profile 134 that is operable to engage the cased wellbore. Anchor slips 100 are fit about slip ramps 96, 98 such that upon actuation of seal assembly 90, slip ramps 96, 98 engage anchor slips 100 such that anchor slips 100 are radially expanded into an anchoring engagement with the cased wellbore.

Slip ramp 98 is disposed about mandrel at a position below anchor slips 100. In the illustrated embodiments, slip ramp 98 comprises two sections 136, 138 each forming a 180 degree section of slip ramps 98. Sections 136, 138 are welded, bolted or connected together by other suitable technique. Slip ramp 98 is operable to axially slid about mandrel 92. Upon actuation of seal assembly 90, slip ramp 98 axially slides into engagement with seal element 102 in response to the axial movement of slip ramp 96 and anchor slips 100. This results in the radial expansion of seal element 102 into sealing engagement with the cased wellbore.

Seal element 102 is positioned at the far end of mandrel 92 such that flange 110 provides axial support to seal element 102. As illustrated, seal element 102 comprises an extrudable material such as a rubber that is wrapped about mandrel 92 to form multiple layers such as a rubber. The layer of extrudable material may be coupled together by crosslinking an other suitable process. Seal element 102 may slide relative to mandrel 92 to allow radial expansion. More specifically, upon actuation of seal assembly 90, slip ramp 98 compresses seal element 102 axially against flange 110, thereby radially expanding seal element 102 into sealing engagement with cased wellbore. This particular embodiment of seal element 102 will be described in more detail below.

Alternatively, a seal element may comprise multiple sections of extrudable material. The sections of extrudable material are coupled together by crosslinking, an epoxy or other suitable means. This particular embodiment of a seal element will be described in more detail below. As yet another alternative, a seal element may comprise two seal members in a jointed slidably engagable relationship. The seal members are preferably an extrudable material. Upon actuation of such a seal assembly, the first seal member slidably engages the second seal member along such that included planes radially expand sections of each seal member. This particular embodiment of a seal element will be described in more detail below.

Thus seal assembly 90 of the present invention provides a system and method for creating a fluid seal between production tubing and well casing that does not require a complex conventional packer. The split design of the seal assembly allows the seal assembly to be employed with a continuous tubing to create a sealing system that provides an effective engagement and sealing with the cased wellbore.

Figure 5:
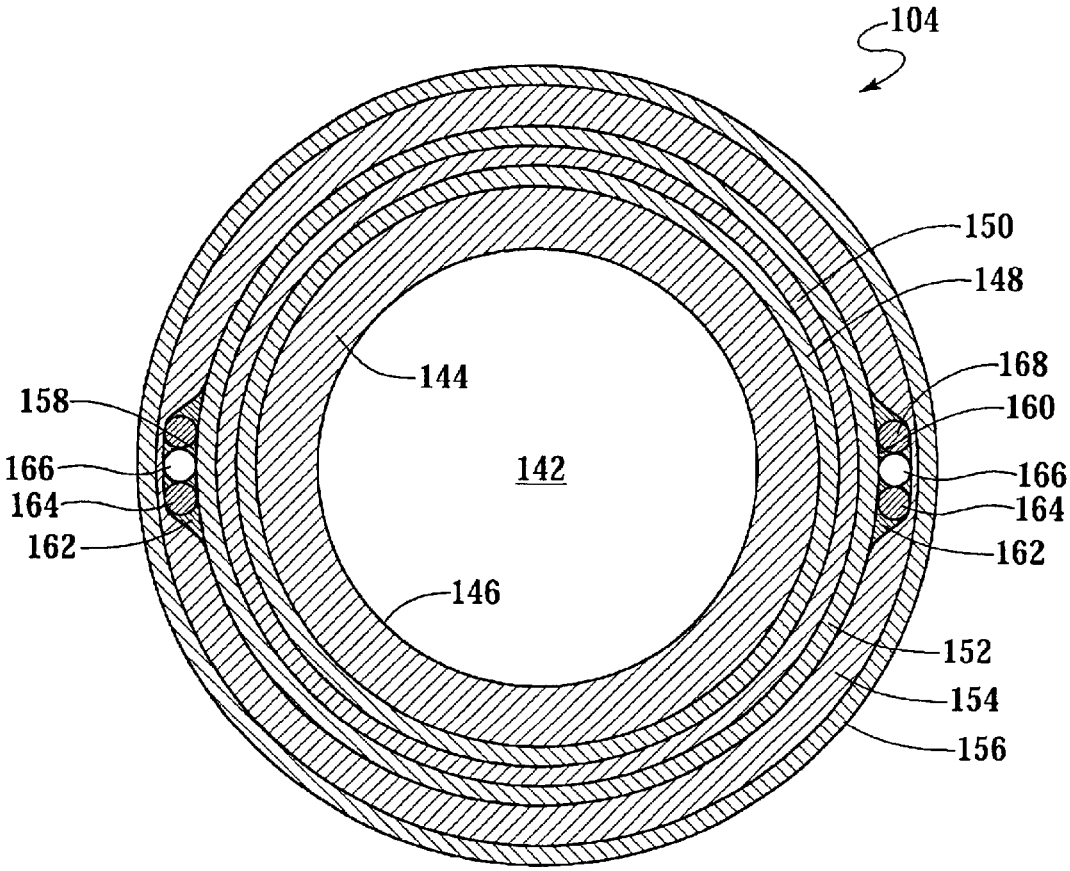
FIG. 5 is a cross sectional view of a composite coiled tubing that may be employed in the seal assembly of the present invention taken along line 5—5 of FIG. 4.

Referring now to FIG. 5, a composite coiled tubing 104 of the seal assembly of FIG. 4 is depicted in cross section taken along line 5—5 of FIG. 4. Composite coiled tubing 104 includes an inner fluid passageway 142 defined by an inner thermoplastic liner 144 that provides a body upon which to construct the composite coiled tubing 104 and that provides a relative smooth interior bore 146. Fluid passageway 142 provides a conduit for transporting fluids such as production fluids. Layers of braided or filament wound material such as Kevlar or carbon encapsulated in a matrix material such as epoxy surround liner 144 forming a plurality of generally cylindrical layers, such as layers 148, 150, 152, 154 and 156 of composite coiled tubing 104.

A pair of oppositely disposed inner areas 158, 160 are formed within composite coiled tubing 104 between layers 152 and 154 by placing layered strips 162 of carbon or other stiff material therebetween. Inner areas 158, 160 are configured together with the other structural elements of composite coiled tubing 104 to provide high axial stiffness and strength to the outer portion of composite coiled tubing 104 such that composite coiled tubing 104 has greater bending stiffness about the major axis as compared to the bending stiffness about the minor axis to provide a preferred direction of bending about the axis of minimum bending stiffness when composite coiled tubing 104 is spooled and unspooled.

Accordingly, the materials of composite coiled tubing 104 provide for high axial strength and stiffness while also exhibiting high pressure carrying capability and low bending stiffness. For spooling purposes, composite coiled tubing 104 is designed to bend about the axis of the minimum moment of inertia without exceeding the low strain allowable characteristic of uniaxial material, yet be sufficiently flexible to allow the assembly to be bent onto the spool.

Inner areas 158, 160 have conduits 164 that may be employed for a variety of purposes. For example, conduits 164 may be power lines, control lines, communication lines or the like that are coupled between the seal assembly and the surface. Specifically, conduits 164 include hydraulic fluid conduits 166 and electrical conduits 168 for providing either hydraulic or electric service, respectively, to the seal assembly. Additionally, other control or communication line may provide for the exchange of control signals or data between the surface and the seal assembly. Although a specific number of conduits 164 are illustrated in FIG. 5, it should be understood by one skilled in the art that more or less conduits 164 than illustrated are in accordance with the teachings of the present invention. Moreover, it should be understood by one skilled in the art that not all of the conduits 164 are employed by a single seal assembly. Conduits 164, as described above, may be used for a variety of purposes such as operating multiple seal assemblies.

The design of composite coiled tubing 104 provides for production fluids to be conveyed in fluid passageway 142 and conduits 164 to be positioned in the matrix about fluid passageway 142. It should be understood by those skilled in the art that while a specific composite coiled tubing is illustrated and described herein, other composite coiled tubings having a fluid passageway and one or more conduits could alternatively be used and are considered within the scope of the present intention.

Figure 6:
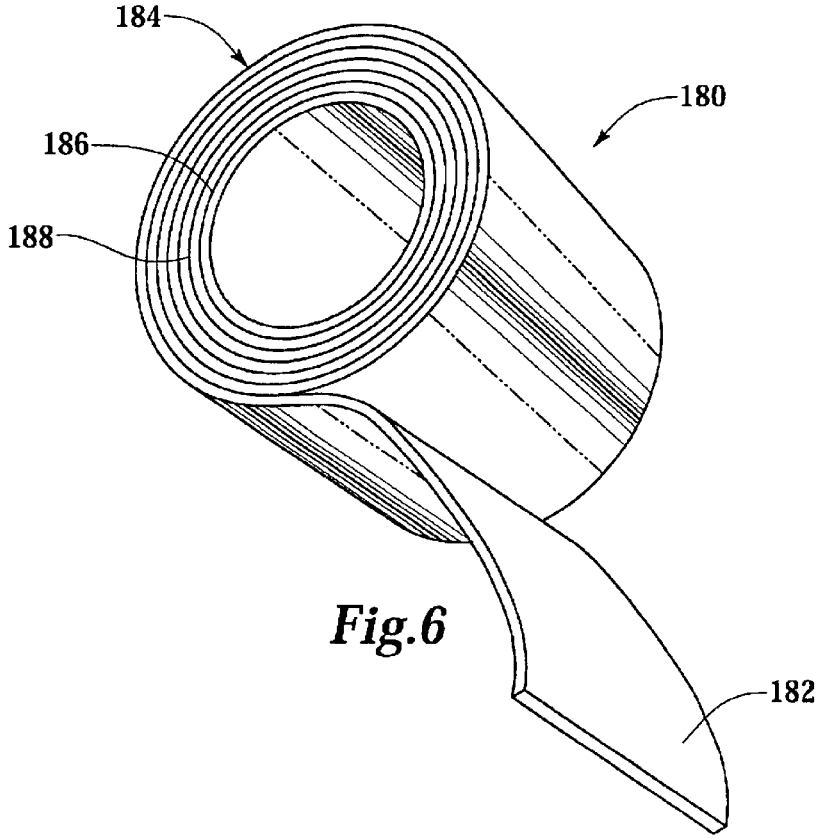
FIG. 6 is a perspective view of an embodiment of a seal element of the present invention that includes a wrapped extrudable material.

Referring now to FIG. 6, a seal element 180 of the present invention that includes a wrapped extrudable material 182 is illustrated. As discussed above, extrudable material 182 is wrapped about a mandrel positioned and a section of a continuous tubular to form a plurality of layers 184, such as layers 186, 188. Preferably, extrudable material 182 comprises elastomers or rubbers. Once wrapped about the mandrel on the section of a continuous tubular, the extrudable material 182 is subjected to a crosslinking reaction to increase the strength and resiliency of extrudable material 182 and to unitize layers 184 of seal element 180. A suitable crosslinking reaction is vulcanization which may be carried out by employing an accelerator such as a zinc salt of dithiocarbamic acid. Alternatively, radiation crosslinking may be employed by irradiating extrudable material 182. As another alternative, photochemical crosslinking may be employed with the use of ultraviolet or visible light in combination with photosensitizers or other light-initiated polymerization group embedded in the extrudable material. The photosensitizers or other light initiated polymerization group absorbs light energy, thereby inducing crosslinking. Additionally, crosslinking may be achieved chemically by employing, for example, dihalogen compounds or ionomers (ionic crosslinking). These crosslinking reactions are presented by way of example, and not by way of limitation. Accordingly, other crosslinking reactions known within the art are within the scope of the present invention.

Figure 7:
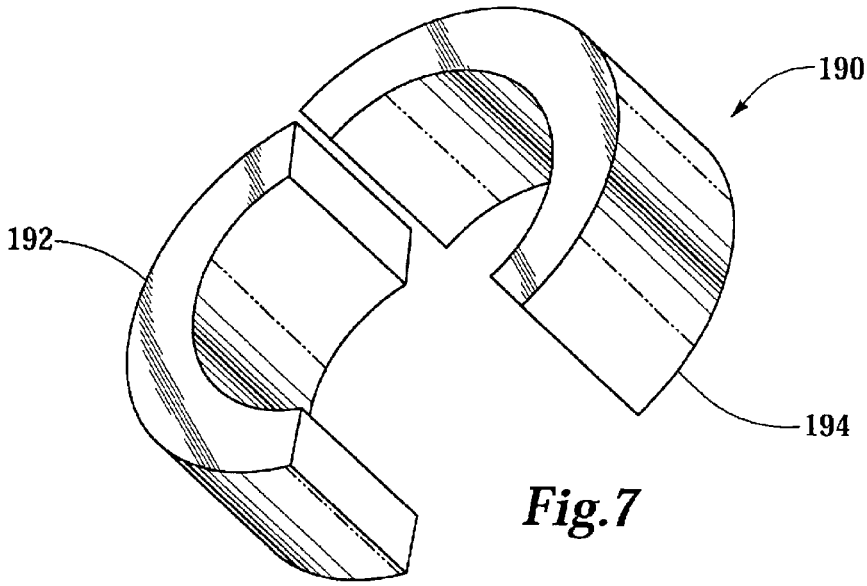
FIG. 7 is a perspective view of a seal element of the present invention that includes a plurality of arc shaped segments sections of an extrudable material.

Referring now to FIG. 7, an alternative embodiment of a seal element is illustrated and generally designated 190. Seal element 190 includes two arc shaped segments 192, 194 that are positioned around the mandrel on the continuous section of tubular. Segments 192, 194 are preferably made from an extrudable material such as elastomers or rubbers. Preferably, segments 192, 194 are subjected to a crosslinking reaction to increase the strength and resiliency of the extrudable material and to unitize segments 192, 194 of seal element 190 into an annular member. As previously discussed in detail, the crosslinking reaction may be vulcanization, a radiation crosslinking reaction, a photochemical crosslinking reaction, a chemical crosslinking reaction, or other reaction known in the art. It should be understood by those skilled in the art that although two arc shaped segments are shown in FIG. 7, any shape or number of segments may alternatively be used and are considered within the teachings of the present invention. Moreover, one skilled in the art should understand that each arc shaped segment used to form seal element 190 may have the same or a different arc length.

Figure 8:
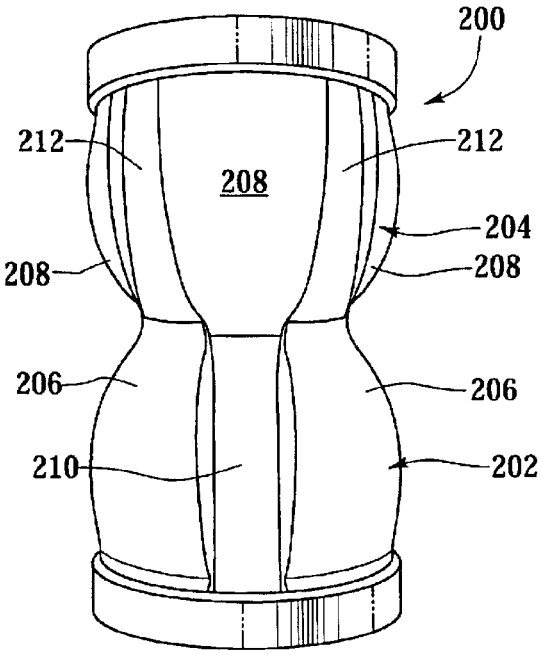
FIGS. 8 and 9 are perspective views of a seal element of the present invention that includes a pair of sections that have a jointed slidably engagable relationship.
Figure 9:
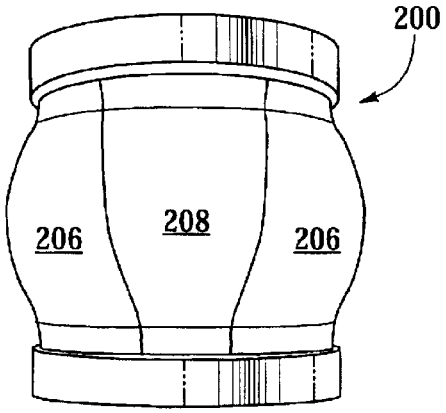

Referring now to FIGS. 8 and 9, another alternative embodiment of a seal element of the present invention is illustrated and generally designated 200. Seal element 200 comprises a first section 202 and a second section 204 that have a jointed slidably engagable relationship relative to one another. First section 202 and second section 204 respectively include a plurality a seal members 206, 208 that are formed from an extrudable material such as a polymer or a rubber. First section 202 includes a plurality of tracks for each of the seal members 208 of second section 204 such as track 210. Likewise, second section 204 includes tracks 212 for each of the seal members 206 of first section 202. Tracks 210, 212 serve as guides for the respective seal members 206, 208 such that when seal assembly 200 is actuated by a compressive axial force between a slip ramp and a flange, seal members 206 of first section 202 mesh with seal members 208 of second section 204 and are radially expanded, as best seen in FIG. 9, to provide a seal.

Figure 10:
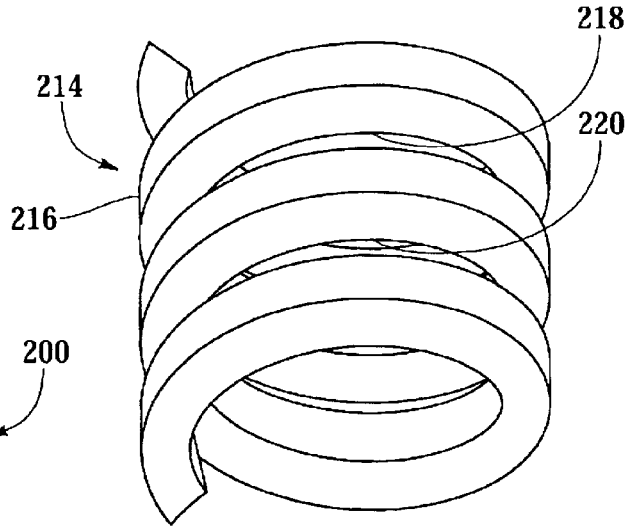
FIG. 10 is a perspective view of a seal element of the present invention that includes a spiral segment of an extrudable material.

Referring now to FIG. 10, an alternative embodiment of a seal element is illustrated and generally designated 214. Seal element 214 includes a spoolable member 216 that is wound around the mandrel on the continuous section of tubular to form multiple turns, such as turns 218, 220. Preferably, spoolable member 216 is wound around the mandrel in a spiral or helical pattern. Spoolable member 216 is preferably made from an extrudable material such as elastomers or rubbers. Preferably, spoolable member 216 is subjected to a crosslinking reaction to increase the strength and resiliency of the extrudable material and to unitize spoolable member 216 of seal element 190 into an annular member. As previously discussed in detail, the crosslinking reaction may be vulcanization, a radiation crosslinking reaction, a photochemical crosslinking reaction, a chemical crosslinking reaction, or other reaction known in the art.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A seal assembly for controlling the flow of fluids in a wellbore comprising:

a nonjointed tubular having a fluid passageway therethrough, the nonjointed tubular forming an annulus with the wellbore;

a seal element positioned externally around the nonjointed tubular, the seal element operable to block the flow of fluids through the annulus between the nonjointed tubular and the wellbore when the seal element is in a sealing position; and a setting assembly positioned externally around the nonjointed tubular operable to actuate the seal element from a non sealing position to the sealing position.

2. The seal assembly as recited in claim 1 wherein the nonjointed tubular further comprises a composite coiled tubing.

3. The seal assembly as recited in claim 2 wherein the composite coiled tubing further comprises a plurality of composite layers, a substantially impermeable material lining an inner surface of the innermost composite layer forming the fluid passageway and a control conduit integrally positioned between two of the composite layers.

4. The seal assembly as recited in claim 3 wherein the control conduit further comprises a hydraulic fluid conduit that supplies hydraulic fluid to operate the setting assembly.

5. The seal assembly as recited in claim 3 wherein the control conduit further comprises an electrical conduit operable to control the petting assembly.

6. The seal assembly as recited in claim 1 further comprising first and second slip ramps positioned around the nonjointed tubular and anchor slips positioned around the nonjointed tubular and between the first and second slip ramps, the anchor slips radially extendable into a gripping engagement with the wellbore in response to relative axial movement of the first and second slip ramps toward one another created by the setting assembly.

7. The seal assembly as recited in claim 6 wherein the seal element is actuatable into the sealing position with the wellbore in response to a compressive axial force applied to the seal element by the second slip ramp.

8. The seal assembly as recited in claim 1 wherein the seal element further comprises an extrudable material.

9. The seal assembly as recited in claim 8 wherein the extrudable material comprises a material selected from the group consisting of elastomers and rubbers.

10. The seal assembly as recited in claim 9 wherein the seal element subjected to a crosslinking reaction to increase the strength and resiliency of the extrudable material and to unitize the seal element.

11. The seal assembly as recited in claim 10 wherein the crosslinking reaction is selected from the group consisting of vulcanization, a radiation crosslinking reaction, a photochemical crosslinking reaction and a chemical crosslinking reaction.

12. The seal assembly as recited in claim 1 wherein the seal element further comprises a plurality of arc shaped segments that are positioned around the nonjointed tubular to form an annular member.

13. The seal assembly as recited in claim 1 wherein the seal element further comprises a sheet that is wrapped around the continous section of the tubular to form a plurality of layers.

14. The seal assembly as recited in claim 1 wherein the seal element further comprises first and second sections having a jointed slidably engageable relationship, the first and second sections each having a plurality of seal members that form a sealing engagement with the wellbore in response to the first and second sections being axially shifter toward one another.

15. The seal assembly as recited in claim 1 wherein the seal element further comprises a spoolable member that is wound around the nonjointed tubular to form a plurality of turns.

16. A hydraulic control assembly for actuating a hydraulically controllable downhole device comprising:

a nonjointed tubular having an inner surface defining a fluid passageway therethrough and an outer surface;

a hydraulically controllable downhole device operably positioned around the outer surface of the nonjointed tubular;

an operating fluid conduit positioned between the inner and outer surfaces of the nonjointed tubular, the operating fluid conduit being in fluid communication with the hydraulically controllable downhole device; and a hydraulic fluid source operably associated with the operating fluid conduit, the hydraulic fluid source providing a pressurized hydraulic fluid that selectively actuates the hydraulically controllable downhole device.

17. The hydraulic control assembly as recited in claim 16 wherein the nonjointed tubular further comprises a composite coiled tubing.

18. The hydraulic control assembly as recited in claim 17 wherein the composite coiled tubing further comprises a plurality of composite layers and a substantially impermeable material lining forming he inner surface, wherein the operating fluid conduit is integraly positioned between two of the composite layers.

19. The hydraulic control assembly as recited in claim 16 wherein the hydraulically controllable downhole device further comprises a seal assembly.

20. The hydraulic control assembly as recited in claim 19 wherein the seal assembly further comprises:

first and second slip ramps positioned around the composite coiled tubing;

anchor slips positioned around the composite coiled tubing between the slip ramps, the anchor slips radially extendable into a gripping engagement against a wellbore in response to relative axial movement of the first and second slip ramps toward one another;

a setting assembly positioned around the section of composite coiled tubing and in fluid communication with the operating fluid conduit, the setting assembly hydraulically actuatable to axially shift the first slip ramp toward the second slip ramp; and a seal element positioned around the composite coiled tubing, the seal element radially expandable into a sealing engagement with the wellbore in response to a compressive axial force applied to the seal element by the second slip ramp after actuation of the setting assembly.

21. The hydraulic control assembly as recited in claim 20 wherein the seal element further comprises a plurality of arc shaped segments that are positioned around the composite coiled tubing to form an annular member.

22. The hydraulic control assembly as recited in claim 20 wherein the seal element further comprises a sheet that is wrapped around the composite coiled tubing to form a plurality of layers.

23. The hydraulic control assembly as recited in claim 20 wherein the seal element comprises first and second sections having a jointed slidably engagable relationship, the first and second sections each having a plurality of seal members that form a sealing engagement with the wellbore in response to the first and second sections being axially shifted toward one another.

24. The hydraulic control assembly as recited in claim 20 wherein the seal element comprises a spoolable member wound around the composite tubing to form a plurality of turns.

25. A seal assembly for controlling the flow of fluids in a wellbore comprising:

a section of composite coiled tubing including a plurality of composite layers, a substantially impermeable material lining an inner surface of the innermost composite layer forming a fluid passageway and an operating fluid conduit integrally positioned between two of the composite layers;

a mandrel having a flange positioned around the section of composite coiled tubing;

first and second slip ramps positioned around the mandrel;

anchor slips positioned around the mandrel between the first and second slip ramps, the anchor slips radially extendable into a gripping engagement against the wellbore in response to relative axial movement of the first and second slip ramps toward one another;

a setting assembly positioned around the mandrel and in fluid communication with the operating fluid conduit, the setting assembly hydraulically actuatable to axially shift the first slip ramp toward the second slip ramp; and a seal element positioned around the mandrel between the flange and the second slip ramp, the seal element radially expandable into a sealing engagement with the wellbore in response to a compressive axial force applied to the seal element between the second slip ramp and the flange after actuation of the setting assembly.

26. The seal assembly as recited in claim 25 wherein the seal element further comprises a plurality of arc shaped segments that are positioned around the mandrel to form an annular member.

27. The seal assembly as recited in claim 25 wherein the seal element further comprises a sheet that is wrapped around the mandrel to form a plurality of layers.

28. The seal assembly as recited in claim 25 wherein the seal element comprises first and second sections having a jointed slidably engagable relationship, the first and second sections each having a plurality of seal members that form a sealing engagement with the wellbore in response to the first and second sections being axially shifted toward one another.

29. The seal assembly as recited in claim 25 wherein the seal element further comprises a spoolable member that is wound around the mandrel to form a plurality of turns.

30. A method for assembling a seal assembly on a nonjointed tubular having an operating fluid conduit associated therewith, the method comprising the steps of:

positioning a mandrel having a flange around the exterior of the nonjointed tubular;

disposing first and second slip ramps around the mandrel;

positioning anchor slips around the mandrel between the first and second slip ramps;

coupling a setting assembly around the mandrel;

establishing fluid communication between the operating fluid conduit and the setting assembly; and positioning a seal element around the mandrel between the flange and the second slip ramp, such that upon hydraulic actuation of the setting assembly, the first and second slip ramps radially expand the anchor slips and the seal element is radially expanded in response to a compressive axial force applied to the seal element between the second slip ramp and the flange.

31. The method as recited in claim 30 wherein the step of positioning a seal element around the mandrel between the flange and the second slip ramp further comprises subjecting the seal element to a crosslinking reaction to increase the strength and resiliency of the seal element.

32. The method as recited in claim 31 wherein the step of subjecting the seal element to a crosslinking reaction to increase the strength and resiliency of the seal element further comprises selecting the crosslinking reaction from the group consisting of vulcanizing, radiation crosslinking, photochemical crosslinking and chemical crosslinking.

33. The method as recited in claim 30 wherein the step of positioning a seal element around the mandrel between the flange and the second slip ramp further comprises positioning a plurality of arc shape segments around the mandrel and forming a substantially unitized annular member.

34. The method as recited in claim 30 wherein the step of positioning a seal element around the mandrel between the flange and the second slip ramp further comprises wrapping a sheet around the mandrel to form a plurality of layers and forming a substantially unitized annular member.

35. The method as recited in claim 30 wherein the step of positioning a seal element around the mandrel between the flange and the second slip ramp further comprises positioning first and second sections having a jointed slidably engagable relationship around the mandrel, the first and second sections each having a plurality of seal members that radially expand in response to the first and second sections being axially shifted toward one another.

36. The method as recited in claim 30 wherein the step of positioning a seal element around the mandrel between the flange and the second slip ramp further comprises winding a spoolable member around the mandrel to form a plurality of turns.

37. A method for operating a seal assembly comprising the steps of:

positioning the seal assembly around a nonjointed tubular, the seal assembly comprising a mandrel having a flange positioned around the nonjointed tubular, first and second slip ramps positioned around the mandrel, anchor slips positioned round the mandrel between the first and second slip ramps, a setting assembly coupled around the mandrel and in fluid communication with an operating fluid conduit integral with the nonjointed tubular and a seal element positioned around the mandrel between the flange and the second slip ramp;

disposing the seal assembly within a wellbore;

communicating an operating fluid to the setting assembly through the operating fluid conduit;

axially shifting the first slip ramp toward the second slip ramp with the setting assembly;

radially expanding the anchor slips into gripping engagement with the wellbore in response to the relative axially movement of the first and second slip ramps; and radially expanding the seal element into sealing engagement with the wellbore in response to a compressive axial force applied to the seal element between the second slip ramp and the flange.

* * * * *